US008813833B2

(12) United States Patent
Nara

(10) Patent No.: US 8,813,833 B2
(45) Date of Patent: Aug. 26, 2014

(54) HEAT EXCHANGING DEVICE FOR POWDER, AND METHOD FOR MANUFACTURING THE SAME

(75) Inventor: Yorioki Nara, Tokyo (JP)

(73) Assignee: Nara Machinery Co., Ltd., Tokyo (JP)

( * ) Notice: Subject to any disclaimer, the term of this patent is extended or adjusted under 35 U.S.C. 154(b) by 1055 days.

(21) Appl. No.: 12/311,317

(22) PCT Filed: Oct. 23, 2007

(86) PCT No.: PCT/JP2007/070985

§ 371 (c)(1),
(2), (4) Date: Mar. 26, 2009

(87) PCT Pub. No.: WO2008/050887

PCT Pub. Date: May 2, 2008

(65) Prior Publication Data

US 2010/0018671 A1 Jan. 28, 2010

(30) Foreign Application Priority Data

Oct. 25, 2006 (JP) ..... 2006-290359

(51) Int. Cl.
*B01F 15/06* (2006.01)
*F28F 5/00* (2006.01)
*F28F 5/06* (2006.01)

(52) U.S. Cl.
USPC ..... 165/92; 165/86; 165/87; 366/147

(58) Field of Classification Search
USPC ..... 165/86, 87, 96, 104.15, 104.16, 104.18; 366/7, 22, 144, 147; 34/179
See application file for complete search history.

(56) References Cited

U.S. PATENT DOCUMENTS

| | | | | | |
|---|---|---|---|---|---|
| 2,731,241 | A | * | 1/1956 | Christian | 165/87 |
| 3,391,733 | A | * | 7/1968 | Stevens | 165/86 |
| 3,500,901 | A | * | 3/1970 | Mery et al. | 165/86 |
| 3,613,777 | A | * | 10/1971 | Nara | 165/86 |
| 3,777,810 | A | * | 12/1973 | Phillips | 165/92 |
| 3,923,097 | A | * | 12/1975 | Hovad | 165/92 |
| 3,951,206 | A | * | 4/1976 | Williams et al. | 165/92 |

(Continued)

FOREIGN PATENT DOCUMENTS

FR 1294663 * 7/1961

OTHER PUBLICATIONS

The International Search Report of the International Searching Authority in corresponding international application No. PCT/JP2007/070985 mailed on Jan. 29, 2008 (English version).

*Primary Examiner* — Allen Flanigan
*Assistant Examiner* — Jason Thompson
(74) *Attorney, Agent, or Firm* — Posz Law Group, PLC

(57) ABSTRACT

To provide a heat exchanging device for powder, which is capable of suppressing as much as possible the compression force applied to an object to be processed and reducing the manufacturing man-hour (time), while ensuring the piston flowability of the object to be processed. In order to achieve this object, the present invention is a heat exchanging device for powder, which is configured such that a shaft 13 is rotatably supported within a horizontally long casing 1, that a plurality of heat exchangers 30 are disposed at predetermined intervals on the shaft, and that a heat exchanging medium is supplied into the heat exchangers via the shaft, wherein the heat exchangers 30 are formed as substantially hollow disk-shaped heat exchangers each having a notched recess 31 directed to a center from a circumferential edge.

13 Claims, 10 Drawing Sheets

(56) References Cited

U.S. PATENT DOCUMENTS

| | | | | | |
|---|---|---|---|---|---|
| 3,983,931 | A * | 10/1976 | Whitehead et al. | ..... | 165/88 |
| 4,301,860 | A * | 11/1981 | Pozzi | ..... | 165/90 |
| 4,556,324 | A * | 12/1985 | Tynan | ..... | 366/85 |
| 4,658,891 | A * | 4/1987 | Wurtz | ..... | 165/92 |
| 4,695,341 | A * | 9/1987 | Matuska et al. | ..... | 156/161 |
| 4,770,236 | A * | 9/1988 | Kulikowski | ..... | 165/86 |
| 5,230,562 | A * | 7/1993 | Nishimi et al. | ..... | 366/298 |
| 5,669,710 | A * | 9/1997 | Schebesta et al. | ..... | 366/97 |
| 6,170,168 | B1 * | 1/2001 | Fosbol et al. | ..... | 34/184 |
| 2004/0140083 | A1 * | 7/2004 | Kim et al. | ..... | 165/87 |

* cited by examiner

HEAT EXCHANGING DEVICE FOR POWDER, AND METHOD FOR MANUFACTURING THE SAME

CROSS REFERENCE TO RELATED APPLICATIONS

This application is a U.S. national stage application of PCT/JP2007/070985 filed on Oct. 23, 2007, and claims priority to, and incorporates by reference, Japanese Patent Application No. 2006-290359 filed on Oct. 25, 2006.

TECHNICAL FIELD

The present invention relates to a heat exchanging device for drying, heating or cooling powder, and a method for manufacturing the heat exchanging device. The concept of "powder" in this specification contains not only powder, but also particle or granule and their mixture.

BACKGROUND ART

As a heat exchanging device for drying, heating or cooling a variety of powder, an indirect heat transfer agitating type dryer is known.

The one disclosed in, for example, Japanese Examined Patent Application Publication No. S48-44432 (Patent Literature 1, hereinafter) is known as such an indirect heat transfer agitating type dryer. The disclosed device is so configured that a shaft is rotatably supported within a horizontally long casing, that a plurality of heat exchangers are disposed at predetermined intervals on the shaft, and that a heat exchanging medium is supplied into the heat exchangers via the shaft. In this device the powder is dried (heated, cooled) by indirect heat transfer from the shaft and heat exchangers.

Here, the heat exchanger disclosed in Patent Literature 1 uses a wedge-shaped hollow rotating body 50, as shown in FIG. 14. This wedge-shaped hollow rotating body 50 is formed by bringing two pieces of fan-shaped plate materials 51, 51 into contact with each other at one side of their ends while separating the plate materials 51, 51 at the other side to block the periphery thereof with plate materials 52, 53. Therefore, the hollow rotating body 50 is shaped into a wedge in which a front end part 54 at the leading end in a rotation direction forms a line, while a rear end part 55 at the rear end in the rotation direction forms a surface. Two of the wedge-shaped hollow rotating bodies 50 are then disposed as a pair with certain gaps A, A therebetween so as to be symmetric with each other with respect to a shaft 60, as shown in FIG. 15. The two wedge-shaped hollow rotating bodies 50 form a pair and a plurality of the pairs are disposed at predetermined intervals in an axial direction of the shaft 60.

The disclosed in Patent Literature 1 had the following excellent characteristics:

(1) Small installation area and size.

(2) Large heat transfer coefficient and high heat efficiency.

(3) Self-cleaning effect achieved by the wedge-shaped hollow rotating bodies.

(4) The temperature of an object to be processed and the time for processing it can be controlled easily.

(5) Powder with high moisture content can be processed.

(6) Excellent piston flowability (transferability) of the object to be processed.

However, the device described in Patent Literature 1 has such a problem that when the object to be processed is brittle and fragile, it receives a compression force from the wedge-shaped hollow rotating bodies 50 serving as the heat exchangers and thereby becomes pulverized.

Also, a problem in producing the shaft provided with the wedge-shaped hollow rotating bodies is that it requires an enormous amount of time due to the shape of the shaft with the rotating bodies. In other words, the wedge-shaped hollow rotating body 50 is created by disposing the two pieces of fan-shaped plate materials 51, 51, isosceles triangular plate material 52, and trapezoidal plate material 53 in the manner shown in FIG. 16 and welding the entire periphery of the abutting parts. Therefore, when forming a single heat exchanger, the welding process comprises a plurality of processes, and automation of the welding operation is difficult. Furthermore, it is difficult to fix the obtained heat exchanger to the shaft 60. This is because, in order to secure the heat exchangers to the shaft 60, first a plate material 61 formed with notches which are substantially the same shape as a part (opening part) of each heat exchanger that is in contact with the shaft 60, is lined (welded) on the entire outer peripheral surface of the shaft 60, and thereafter the plate material 61, the shaft 60 and the parts of the heat exchangers abutting on the plate material 61 and the shaft 60 need to be welded at the entire periphery of the abutting sections. In such welding, the welding methods of each layer need to be changed. For this reason, the problem of the device described in Patent Literature 1 is that an enormous amount of time is required in forming the heat exchangers.

There is also a device in which a plurality of hollow disks are simply attached to a shaft as heat exchangers. Such a hollow disk-shaped heat exchanger, however, cannot ensure the piston flowability of the object to be processed, which is an excellent characteristic of the wedge-shaped hollow rotating body disclosed in Patent Literature 1. The reason is because, as shown in FIG. 15, the piston flowability of the object to be processed can be secured for the first time by allowing the object to be processed to pass regularly through the gaps A, A of the two wedge-shaped hollow rotating bodies 50, 50 attached to the shaft 60.

Here, the piston flowability are important factors for realizing the first-in-first-out phenomenon of the object to be processed and obtaining residence time, heat history, and reaction time to keep each particle of the powder even, and are important attributes of the heat exchanging device in order to maintain the consistent quality of the object to be processed.

The gaps A, A described in Patent Literature 1 function to transfer powder layer formed at the nearest part (upstream side) within the device from a raw material feeding port side to a product discharge side. At this moment, the wedge-shaped hollow rotating body 50 itself does not have an extrusion force that a screw has. For this reason, in this device, the powder is sliced regularly, such as twice per rotation, in order to be transferred by the gaps A, A simply using the pressure of the powder. Therefore, back mixing or short pass seldom occurs on the powder in this device, so that "the first-in-first-out phenomenon" can be ensured and the piston flowability can be realized. On the other hand, in the case of the device in which simple hollow disk-shaped heat exchangers are attached to the shaft, the object to be processed is transferred from a gap between a casing and each heat exchanger to a downstream side. As a result, the back mixing or short pass phenomenon occurs where a part of the powder layer in the vicinity of the shaft remains in its position, while a part of the same near the casing moves rapidly, whereby the piston flowability cannot be realized.

The present invention has been contrived in view of the above problems of the background art. An object of the present invention is to provide a heat exchanging device for powder, which is capable of suppressing the compression force applied to an object to be processed, as much as possible, while ensuring the piston flowability of the object to be processed, and reducing the manufacturing man-hour (time), as well as a method for manufacturing the heat exchanging device.

DISCLOSURE OF THE INVENTION

In order to achieve the above object, a heat exchanging device for powder according to the present invention is a heat exchanging device for powder, which is configured such that a shaft is rotatably supported within a horizontally long casing, that a plurality of heat exchangers are disposed at predetermined intervals on the shaft, and that a heat exchanging medium is supplied into the heat exchangers via the shaft, wherein at least some of the plurality of heat exchangers are formed as substantially hollow disk-shaped heat exchangers each having a notched recess directed to a center from a circumferential edge.

According to the heat exchanging device for powder according to the present invention, at least some of the plurality of heat exchangers disposed on the shaft are formed into a substantially hollow disk shape with little resistance, whereby the compression force applied to an object to be processed as much as possible. Therefore, even when the object to be processed is brittle and fragile, pulverization thereof can be prevented. Also, because each heat exchanger has a notched recess directed to a center from a circumferential edge, the object to be processed can be allowed to pass through from the notched recess, and the piston flowability of the object to be processed can be ensured. In addition, because each heat exchanger is configured simply into a substantially hollow disk shape, the manufacturing man-hour (time) can be reduced and the welding operation can be automated easily.

Here, in the heat exchanging device for powder according to the present invention, a preferred embodiment of the present invention is to form the notched recess of the each heat exchanger into a smooth curve. Another preferred embodiment of the present invention is to provide two or more of the notched recesses to each heat exchanger at regular intervals in a circumferential direction of each heat exchanger. Yet another preferred embodiment of the present invention is to dispose the plurality of heat exchangers on the shaft, with the notched recesses of the heat exchangers pointing in the same direction. Yet another preferred embodiment of the present invention is to provide a central part of each of the heat exchangers with a projection bulging in a horizontal direction as viewed in side elevation, to form each of the heat exchangers into a substantially hollow disk shape in which a leading end of the projection is formed with an opening part, and to dispose the plurality of heat exchangers thus formed on the shaft by inserting the shaft into the opening part. An additional preferred embodiment of the present invention is to configure the projection of each of the heat exchangers to have a smoothly curved concentric circle.

In order to achieve the above object, a method for manufacturing a heat exchanging device for powder according to the present invention has: a step of forming substantially circular plate-shaped plate materials having a notched recess directed to a center from a circumferential edge and substantially circular opening parts at centers of the plate materials; a step of bending a rim part of each of the substantially circular plate-shaped plate materials in one direction and a rim of each of the central opening parts in another direction; and a step of joining the two substantially circular plate-shaped plate materials that are bent in a direction in which the rim parts are abutted on each other, and welding the circular plate-shaped plate materials at the abutted rim parts to produce substantially hollow disk-shaped heat exchangers, and integrally welding the adjacent heat exchangers to a shaft at a position where leading ends of opening parts of the heat exchangers are abutted on each other, to fix the heat exchangers to the shaft.

According to the method for manufacturing a heat exchanging device for powder according to the present invention, when forming the heat exchangers, the heat exchangers are welded at one section, which is the rim part where the two bent and substantially circular plate-shaped plate materials are abutted on each other (one weld line). Therefore, this operation can be performed in a short time, and the welding operation can be automated extremely easily. Moreover, because the adjacent heat exchangers are integrally welded to the shaft at the leading ends of the opening parts of the heat exchangers, when securing the heat exchangers to the shaft. Therefore, the welding time can be significantly reduced. In this case as well, the welding operation can be automated extremely easily, because there is one weld line.

Here, in the method for manufacturing a heat exchanging device for powder according to the present invention, a preferred embodiment of the present invention is to configure the step of producing the heat exchangers and fixing the heat exchangers to the shaft, with the step of joining the two bent and substantially circular plate-shaped plate materials in the direction in which the rim parts are abutted on each other and welding the circular plate-shaped plate materials at the abutted rim parts, the step of inserting the shaft into the opening parts of the substantially hollow disk-shaped heat exchangers produced in the welding step and disposing the plurality of heat exchangers on the shaft, and the step of integrally welding the disposed adjacent heat exchangers to the shaft at the position where the leading ends of the opening parts of the heat exchangers are abutted on each other. Another preferred embodiment of the present invention is to configure the step of producing the heat exchangers and fixing the heat exchangers to the shaft, with the step of changing alternately the orientations of the bent substantially circular plate-shaped plate materials and inserting the shaft into the opening parts to dispose the plurality of bent substantially circular plate-shaped plate materials on the shaft, and the step of successively performing welding at the rim parts where the disposed substantially circular plate-shaped plate materials are abutted on each other and integral welding of the plate materials with the shaft at the part where the leading ends of the opening parts are abutted on each other. An additional preferred embodiment of the present invention is to provide a trimming step of adjusting the shape and size of each of the bent substantially circular plate-shaped plate materials, subsequent to the bending step.

BEST MODE FOR CARRYING OUT THE INVENTION

Embodiments of the heat exchanging device for powder according to the present invention and of a method for manufacturing for the heat exchanging device are described hereinafter in detail.

Figure 1:
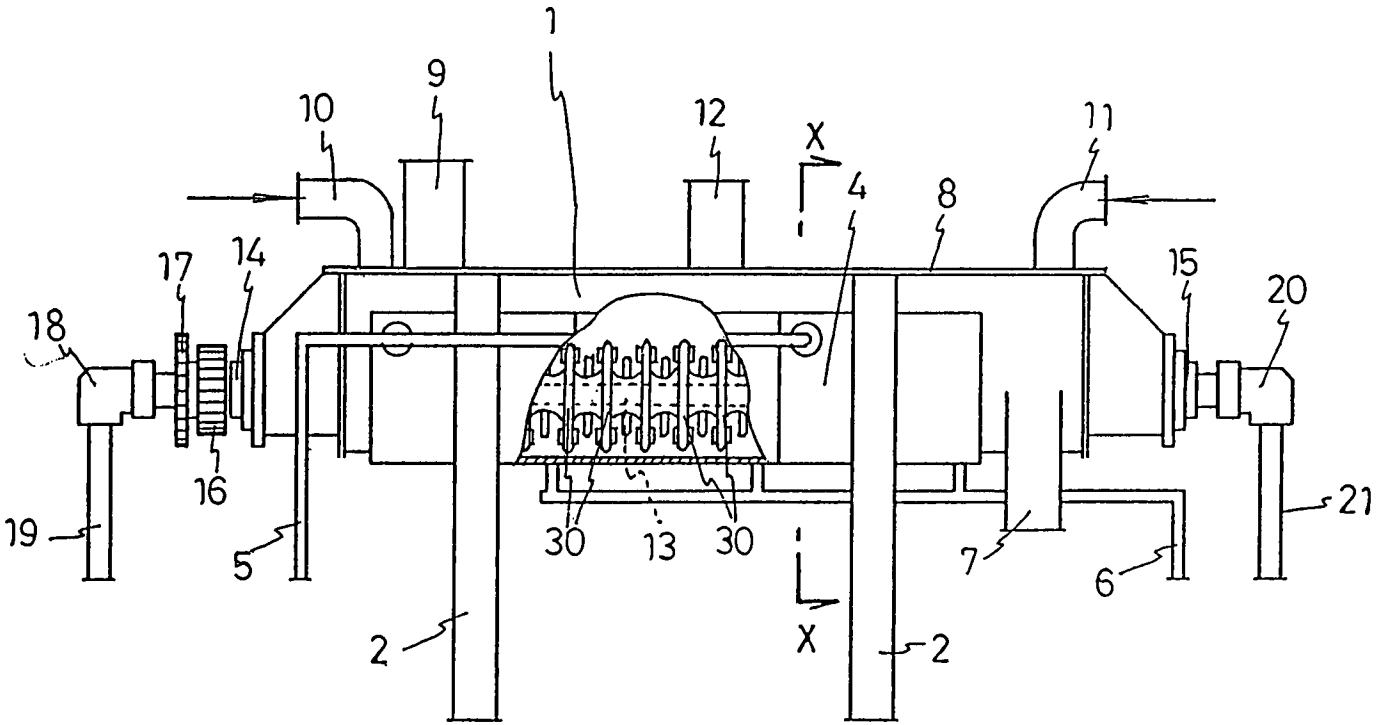
FIG. 1 is a side view showing a part of a heat exchanging device for powder according to the present invention.
Figure 2:
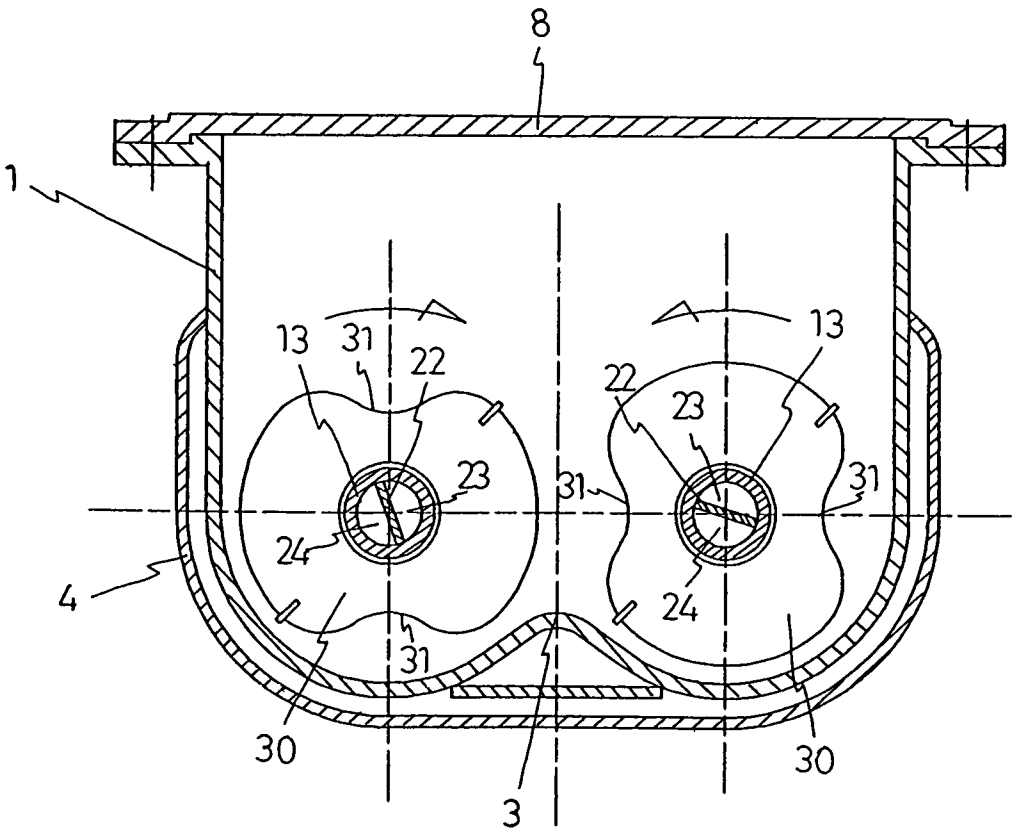
FIG. 2 is an enlarged cross-sectional view of a part taken along line X-X of FIG. 1.

FIG. 1 is a side view showing a part of a heat exchanging device for powder according to the present invention. FIG. 2 is an enlarged cross-sectional view of a part taken along line X-X of FIG. 1.

In these figures, reference numeral 1 represents a casing of the heat exchanging device, which consists of a relatively horizontally long container. This casing 1 is slightly inclined by a support 2 according to need. As shown in FIG. 2, the cross section of the casing 1 is in the shape of a bowl defined by two circular arcs. At a central bottom part of the bowl, a raised body 3 formed by the circular arcs runs in a front-to-rear direction of the casing 1, in the form of a convex. A heat exchange jacket 4 is provided on substantially the entire surface of bottom and side surfaces of the casing 1.

As shown in FIG. 1, a supply pipe 5 and discharge pipe 6 for supplying and discharging a heat exchanging medium are connected to the heat exchange jacket 4. A rear end bottom part of the casing 1 is provided with a discharge port 7 for discharging an object to be processed, and a cover 8 is attached to an upper surface of the casing 1 by a bolt of the like. A front end part of the cover 8 is provided with a feed port 9 for feeding the object to be processed, the front end part and rear end part of the cover 8 with carrier gas inlet ports 10, 11 respectively, and a central part of the cover 8 with a carrier gas discharge port 12.

Also, two hollow shafts 13, 13 run parallel through in the front-to-rear direction of the casing 1. These hollow shafts 13, 13 are supported by bearings 14, 14 and 15, 15 provided in the front and rear parts of the casing 1, so as to be freely rotatable. A front part of each of the shafts 13, 13 is provided with a gear 16, 16. The gears 16, 16 are meshed with each other so that the shafts 13, 13 rotate in the directions opposite to each other. One of the shafts 13 is provided with a sprocket 17. The rotation of a motor (not shown) is transmitted to the shafts 13, 13 via a chain (not shown) meshed with this sprocket 17.

Supply pipes 19, 19 for supplying the heat exchanging medium are connected respectively to front ends of the shafts 13, 13 via rotary joints 18, 18. Similarly, discharge pipes 21, 21 for discharging the heat exchanging medium are connected respectively to rear ends of the shafts 13, 13 via rotary joints 20, 20. As shown in FIG. 2, each of the shafts 13, 13 is provided with a partition plate 22, 22 dividing the inside of the shaft 13 into two in an axial direction. The inside of each shaft 13 is divided by the partition plate 22 into a primary chamber 23 and a secondary chamber 24. The primary chamber 23 is communicated with a front part of the shaft 13, while the secondary chamber 24 is communicated with a rear part of the shaft 13. In this state, although not particularly shown, the above configurations can be realized by sealing a front end of the secondary chamber 24 with a semicircular end plate in the front part of the shaft 13 and sealing a rear end of the primary chamber 23 with a semicircular end plate in the rear part of the shaft 13.

Figure 3:
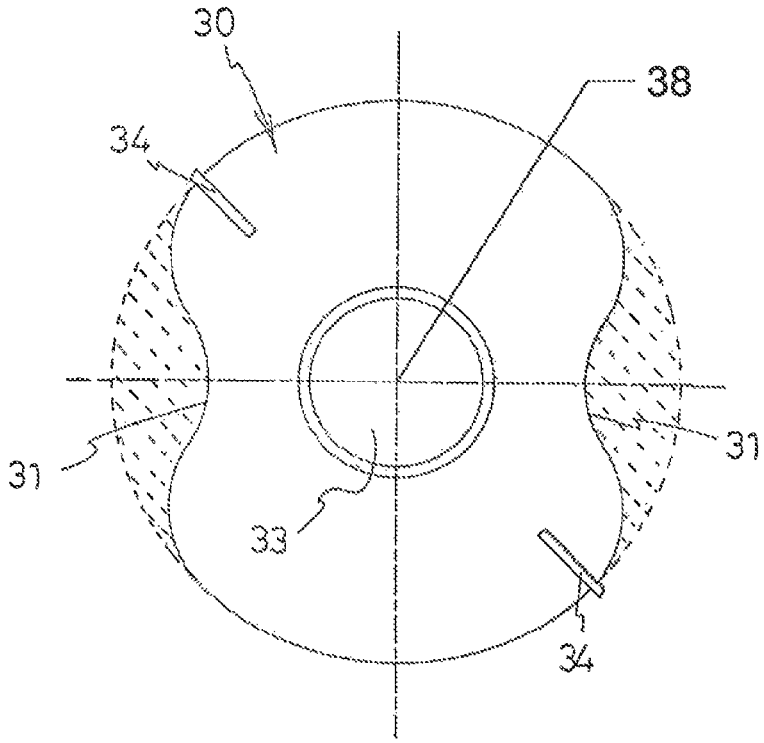
FIG. 3 is a front view of a heat exchanger.
Figure 4:
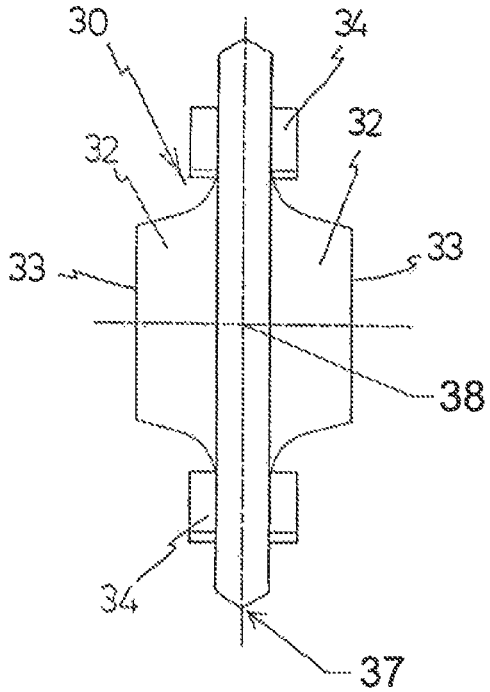
FIG. 4 is a side view of the heat exchanger.
Figure 5:
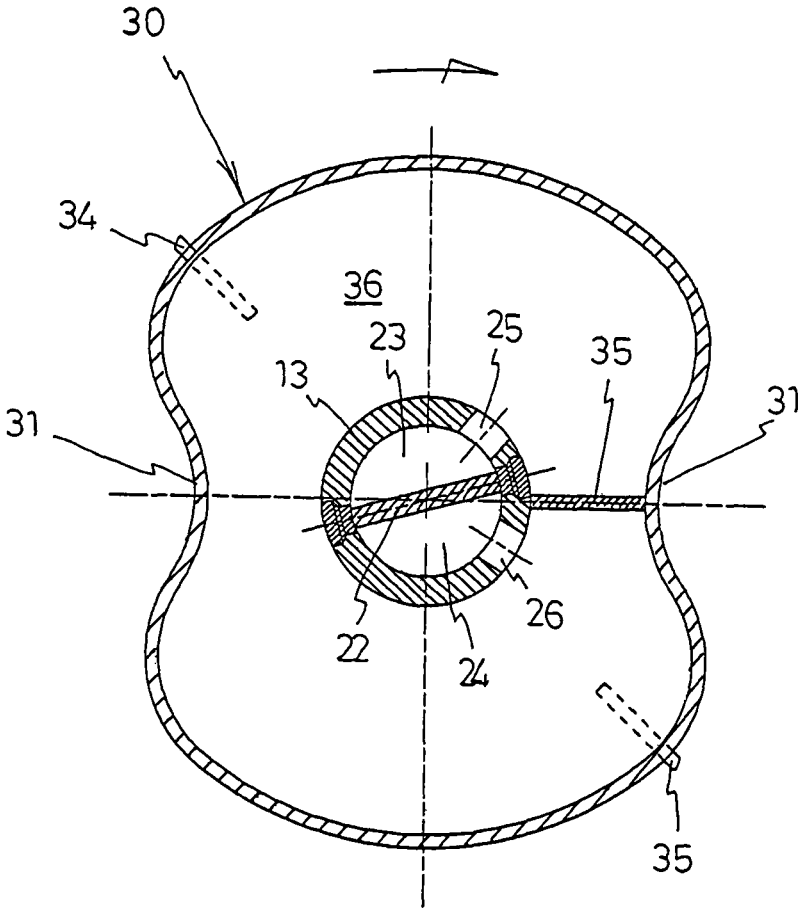
FIG. 5 is a vertical cross-sectional view of the heat exchanger disposed on a shaft.

In addition, in each of the shafts 13, 13, a plurality of heat exchangers 30, 30 . . . are disposed at regular intervals. Each of the heat exchangers 30 is formed into a thin and substantially hollow disk shape, with both plate surfaces disposed in parallel. Specifically, as shown in FIGS. 3 to 5, the heat exchanger 30 has two notched recesses 31, 31 that are directed to the center from respective circumferential edges 37, 37 and placed symmetrically, and, in the center 38 of the heat exchanger 30, concentric projections 32, 32 that are gently curved in a horizontal direction as viewed from the side. Opening parts 33, 33 are formed on leading ends of the projections 32, 32, respectively. It is preferred that the heat exchanger 30 be formed into a so-called cocoon that is relatively thin and flattened out, and that each of the notched recess 31 be configured into a smooth curve, as shown.

Figure 15:
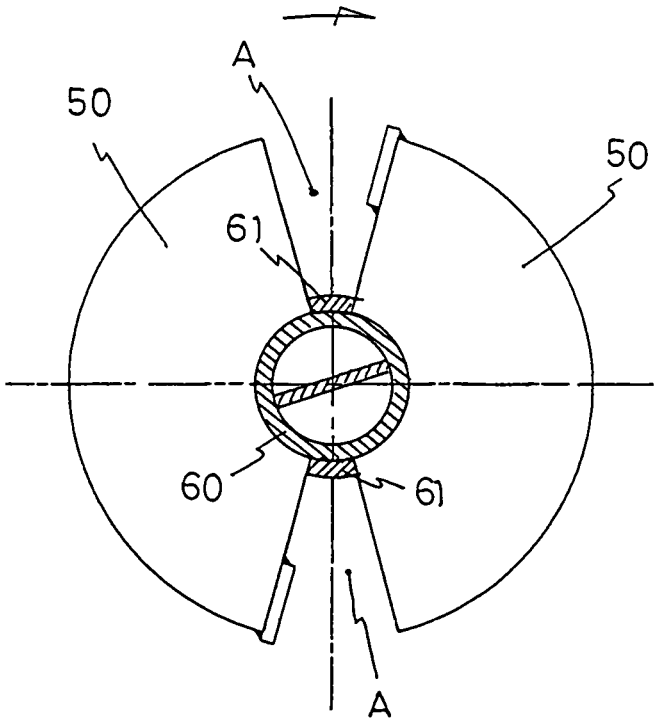
FIG. 15 is a front view of the conventional heat exchanger disposed on a shaft.
Figure 16:
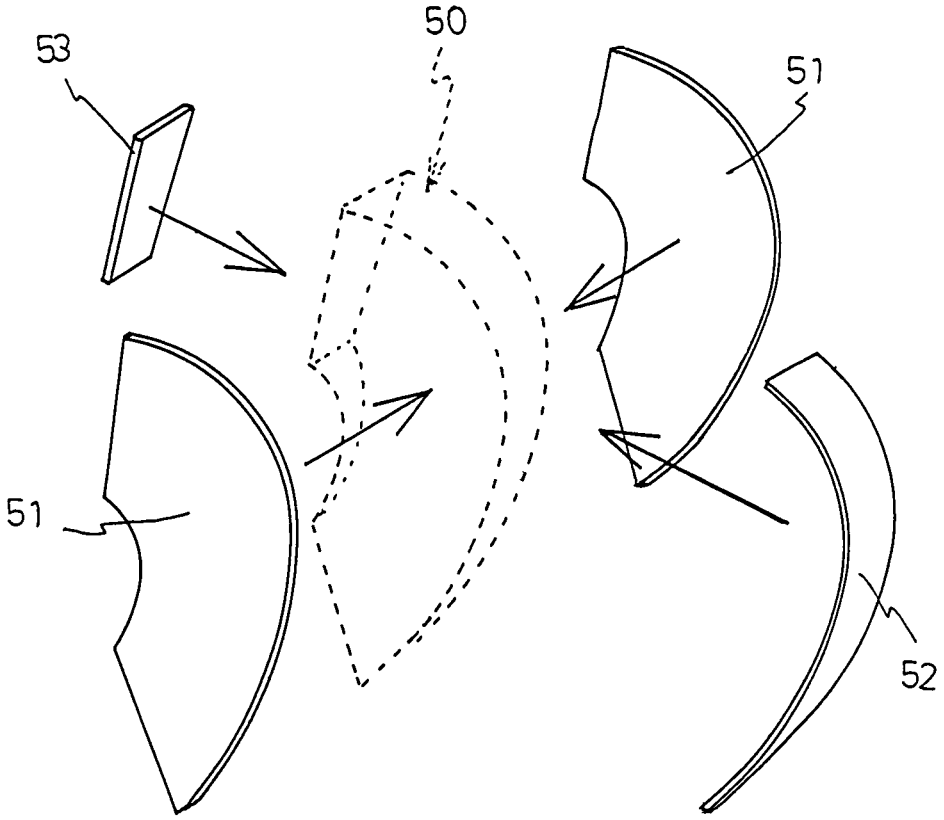
FIG. 16 is a perspective view showing exploded components of the conventional heat exchanger.

Note that the number of the notched recesses 31 formed in the heat exchanger 30 is not limited to two. Specifically, each of the notched recesses 31 may have an opening area that is large enough to allow the passage of the object to be processed. In other words, the areas of the notched recesses 31 (the parts with dotted diagonal lines in FIG. 3) may be equal to the areas of the two fan-shaped gaps A, A that are formed between the two wedge-shaped hollow rotating bodies 50, 50 attached to the same perpendicular surface of the shaft 60 of the conventional technology shown in FIG. 15. Therefore, the number of the notched recesses 31 may be one, three, or more. However, when the number of the notched recesses 31 is two or more, it is preferred that the notched recesses 31 be disposed at regular intervals in a circumferential direction. Moreover, several types of opening area adjusting members (not shown) with different sizes that can be detachable with respect to the notched recesses 31 may be prepared to adjust the areas of the notched recesses 31 on the basis of the property of the object to be processed.

A plurality of the heat exchangers 30 having the above configuration are disposed at regular intervals in each shaft 13 such that the notched recesses 31 of the respective heat exchangers 30 are arranged in the same direction. The distance between the heat exchangers is ensured by causing the leading ends of the projections 32, 32 of the adjacent heat exchangers 30, 30 to abut on each other when the shaft 13 is inserted into the opening parts 33 of the respective heat exchangers 30. Then, when the number of the notched recesses 31 of each heat exchanger 30 is two, the two shafts 13, 13 are disposed with their phases shifted such that the positions of the notched recesses 31, 31 are shifted by 90 degrees, as shown in FIG. 2.

Note that the number of shafts 13 is not limited to two and may be, for example, four or more, or even one (uniaxial). Also, heat exchangers to be disposed on each shaft 13 may all be the abovementioned substantially hollow disk-shaped heat exchangers 30, but they may be combined appropriately with the conventional wedge-shaped heat exchangers 50 and attached to the shaft 13, in accordance with the property of the object to be processed (thermal intensity change). Specifically, the substantially hollow disk-shaped heat exchangers 30 may be attached to only the front half part of the shaft 13 (the feed port 9 side), only the rear half part of the shaft 13 (the discharge port 7 side), or only the middle part of the shaft 13. Conversely, the conventional wedge-shaped heat exchangers 50 may be attached to any of above mentioned each part. The proportion of each of the attached parts can be changed appropriately on the basis of the property of the object to be processed.

As shown in FIG. 3 and the like, a scraping blade 34 is attached to an outer peripheral part on the rear side in the rotation direction of the heat exchangers 30. This scraping blade 34 is attached to each of the heat exchangers 30. However, a bridge-blade (not shown) may be laid between two or more of the adjacent heat exchangers 30, 30 and attached in accordance with the property of the object to be processed. In this case, it is necessary to set the distance between the shafts 13, 13 so that the transfer blade between the heat exchangers 30, 30 of one of the shafts 13 does not collide with the heat exchangers 30 of the other shaft 13.

As shown in FIG. 5, a partition plate 35 is attached to the inside of each heat exchanger 30. This partition plate 35 divides an internal space 36 of the heat exchanger 30 to form a flow in which the heat exchanging medium flowing from the primary chamber 23 of the abovementioned shaft 13 into the internal space 36 of the heat exchanger 30 via a continuous hole 25 circulates through the internal space 36 in a fixed direction and flows out to the secondary chamber 24 of the shaft 13 via a continuous hole 26. Note that in the case of a relatively small device, there may be one partition plate 35. Conversely, in the case of a large device, a plurality of partition plates 35 may be provided to divide the internal space 36 of the heat exchanger 30 smaller, and similarly the continuous holes 25, 26 for communicating the internal space 36 with the primary chamber 23 and the secondary chamber 24 of the shaft may be provided.

The heat exchanger 30 having the above configuration can be created as follows.

Figure 6:
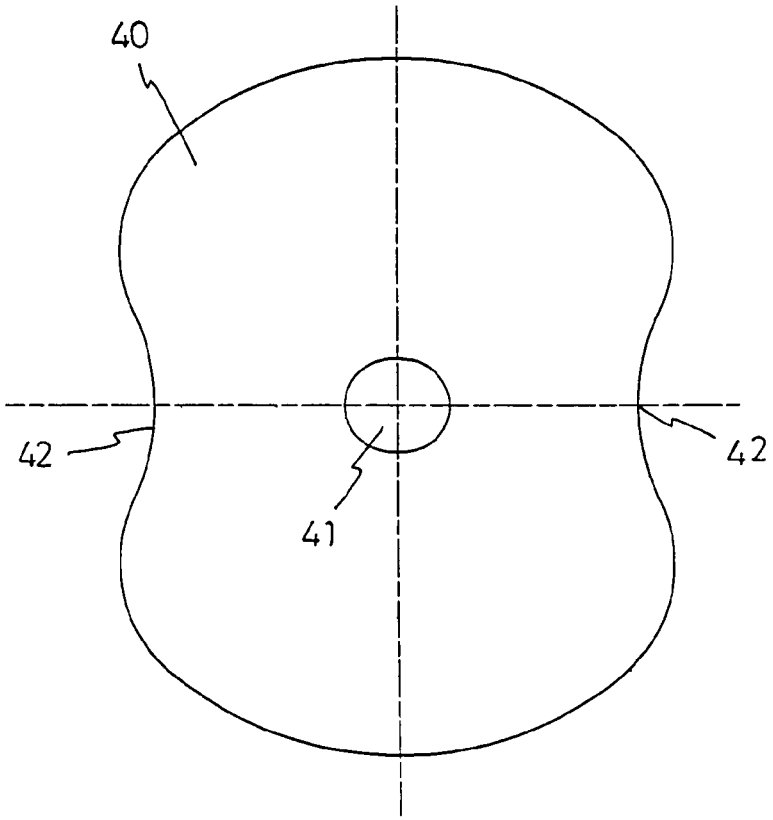
FIG. 6 is a plan view showing a plate material before bent, the plate material configuring the heat exchanger.
Figure 7:
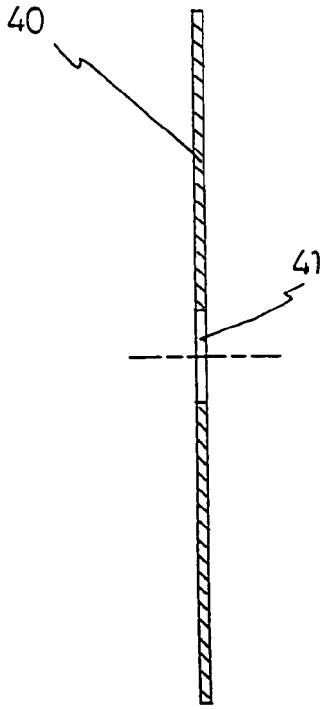
FIG. 7 is a side cross-sectional view showing the plate material before bent, the plate material configuring the heat exchange.

First, a plate material 40 shown in FIGS. 6 and 7 is the one obtained before bending is performed thereon. The shape and size of this plate material 40 are determined in consideration of the finished shape and size of the heat exchanger 30 shown in FIGS. 3 to 5 and FIG. 11. Specifically, this substantially circular plate-shaped plate material 40 has, at the center thereof, a substantially circular opening part 41 corresponding to the opening part 33. The substantially circular plate-shaped plate material 40 also has notched recesses 42, 42 corresponding to the two notched recesses 31, 31, at symmetrical positions of a rim part of the plate material 40.

Figure 8:
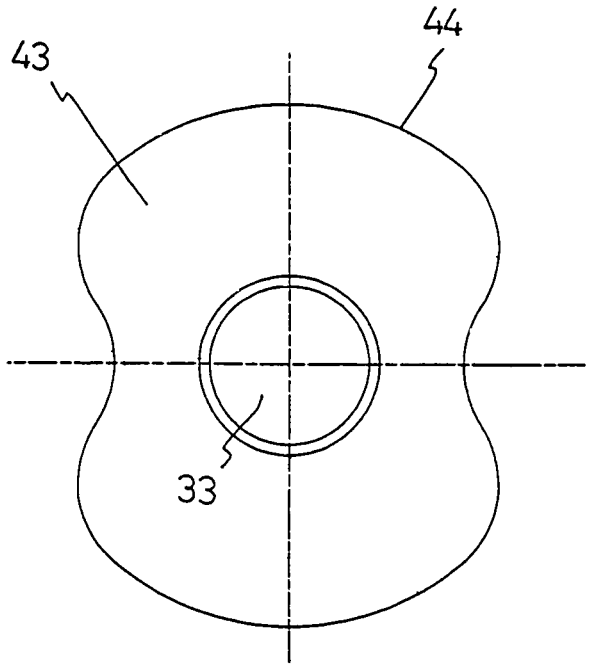
FIG. 8 is a plan view showing the plate material after bent, the plate material configuring the heat exchanger.
Figure 9:
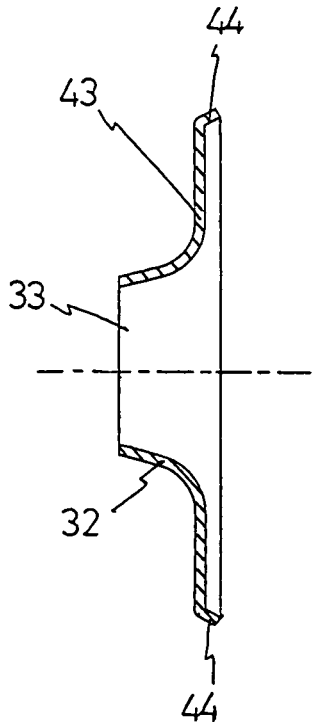
FIG. 9 is a side cross-sectional view showing the plate material after bent, the plate material configuring the heat exchanger.

The plate material 40 is then bent to create a molded article 43 shown in FIGS. 8 and 9. This bending can be performed by means of pressing using a mold constituted by a die (female mold) and punch (male mold). Specifically, a rim part 44 of the plate material 40 is bent approximately 30 degrees in one direction from an outer periphery at a position of a predetermined length (rightward in FIG. 9). In a central part of the plate material 40, the opening part 41 is pushed and expanded to the size of the opening part 33 of the product size and caused to bulge concentrically in the other direction (leftward in FIG. 9) at a relatively large curvature radius, to process the projection 32.

This processing may be performed at once with a pair of molds or performed separately on the rim part and the central part using different molds. It is preferred that the pressing be performed twice in order to form the molded article 43 accurately without deformation. In this case, it is preferred that the central bulging projection 32 be processed first. Moreover, the molded article 43 may be formed more accurately by roughly cutting a plate material into the shape of the plate material 40 in consideration of the finished shape and size of the heat exchanger 30 first, pressing this plate material 40 to process the projection 32, bending the rim part 44, and thereafter trimming the rim part 44 and the projection 32. In this case, the opening 41 may or may not be provided in the center of the plate material 40 in advance.

Figure 10:
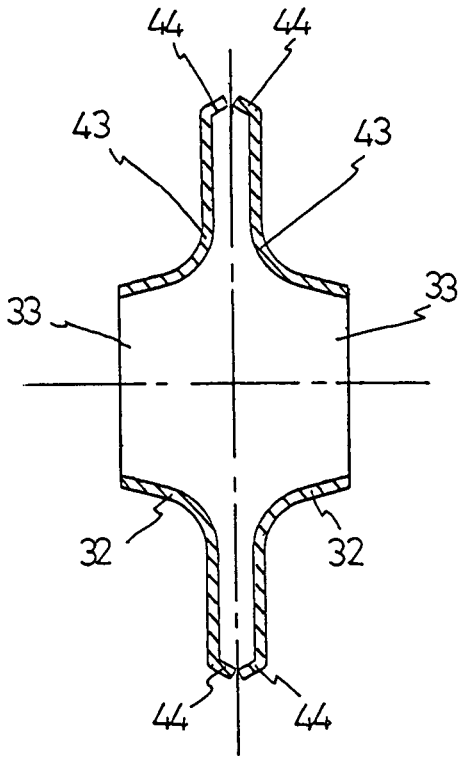
FIG. 10 is a side cross-sectional view showing how a molded article obtained after bending is welded.
Figure 11:
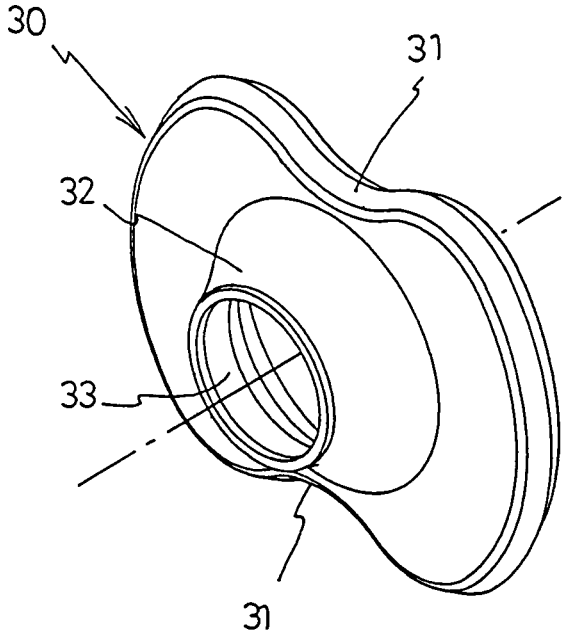
FIG. 11 is a perspective view of the heat exchanger.

Next, the created two molded articles 43, 43 are joined together in a direction in which the rim parts 44, 44 are abutted on each other, as shown in FIG. 10, and the entire periphery of the abutted rim parts 44, 44 is welded. Then, as shown in FIG. 11, the heat exchanger 30 having thin and substantially hollow disk shape with both plate surfaces disposed in parallel is created. At this moment, the partition plate 35 dividing the internal space 36 of the heat exchanger 30 is also attached to the inside by means of welding and the like.

Figure 12:
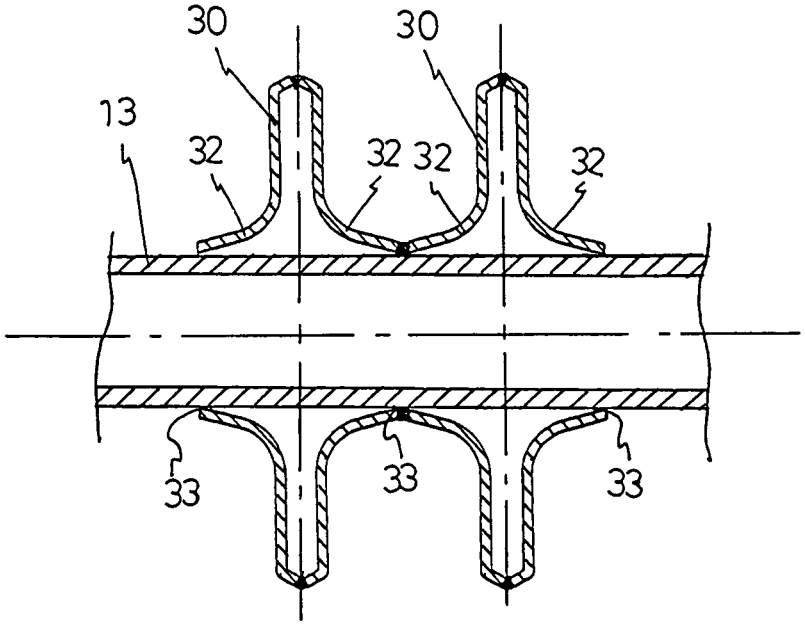
FIG. 12 is a side cross-sectional view showing how the heat exchanger is welded to the shaft.
Figure 13:
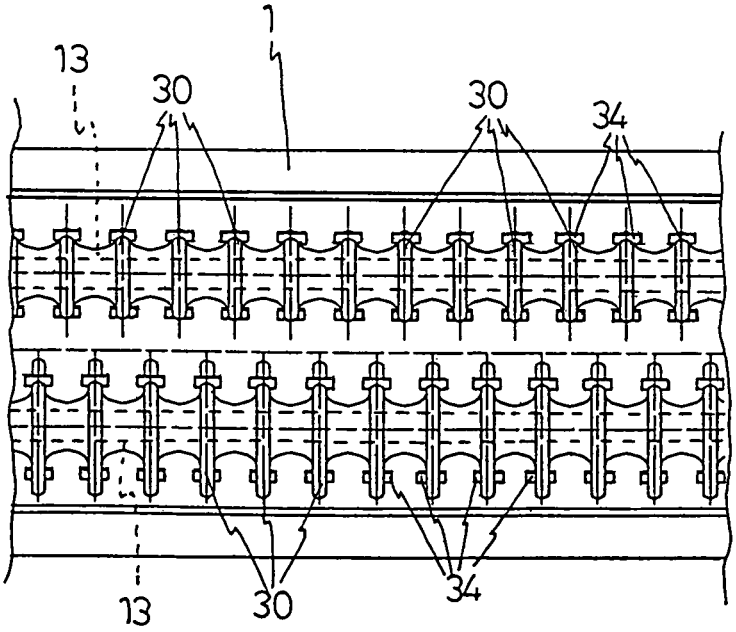
FIG. 13 is a plan view showing how the shaft disposed with the heat exchanger is disposed within a casing.
Figure 14:
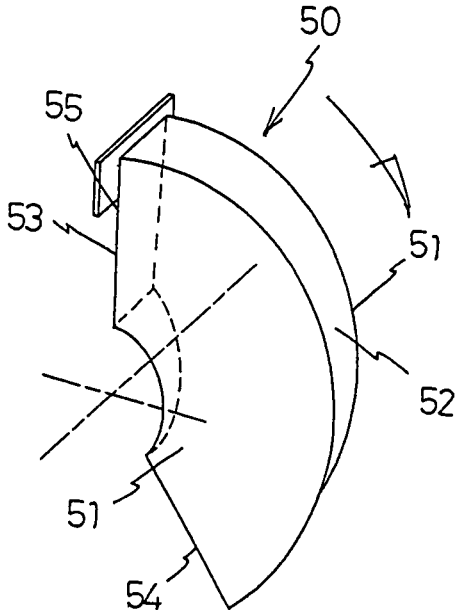
FIG. 14 is a perspective view of a conventional heat exchanger.

Subsequently, the shaft 13 is inserted into the opening part 33 of the created heat exchanger 30, and the plurality of heat exchangers 30, 30 . . . are disposed on the shaft 13. The leading ends of the projections 32, 32 of the respective adjacent heat exchangers 30, 30 disposed on the shaft 13 are abutted on each other, and the entire periphery of the abutted projections 32, 32 is welded, as shown in FIG. 12. Consequently, the abutted part between the adjacent heat exchangers 30, 30 is welded and secured, and the heat exchangers 30 are welded and secured to the surface of the shaft 13. Then, the scraping blade 34 is attached to an appropriate part of the heat exchangers 30 by means of welding or the like, and the shaft 13 disposed with the plurality of heat exchangers 30, 30 . . . at predetermined intervals is disposed within the casing 1, as shown in FIG. 13, to create the heat exchanging device.

Unlike the configuration described above, it is possible to adopt a manufacturing method in which the directions of the molded article 43 is changed without welding the created molded article 43, the shaft 13 is inserted into the opening part 33 of the molded article 43, whereby the plurality of molded articles 43, 43 . . . are disposed on the shaft 13, thereafter welding of the rim parts 44, 44 where the molded articles 43, 43 of the shaft are abutted on each other, and integral welding of the leading end parts of the projections 32, 32 and the shaft 13 are performed successively, to create the substantially hollow disk-shaped heat exchanger 30 and to secure the heat exchanger 30 to the shaft 13.

When producing the heat exchanger 30 of the present invention, it is only necessary to perform the welding in one section, which is the rim parts 44, 44 where the created two molded articles 43, 43 are abutted on each other (one weld line). Therefore, this operation can be performed in a short time, and the welding operation can be automated extremely easily. Also, when securing the heat exchanger to the shaft 13, not only is it possible to weld and secure the heat exchangers 30, 30 to each other, but also the two heat exchangers 30, 30 can be welded and secured to the shaft 13 simultaneously, by performing the welding along the leading end of the projection 33 at which the adjacent heat exchangers 30, 30 are abutted on each other. As a result, the welding time can be significantly reduced. In this case well, the welding operation can be automated extremely easily, because there is one weld line. Furthermore, when manually welding the conventional wedge-shaped heat exchanger 50 to the shaft 60, multi-layer welding had to be performed, the welding methods of each layer need to be changed as mentioned above. However, when welding the heat exchanger 30 of the present invention to the shaft 13 automatically, single-layer welding can be accomplished by selecting an appropriate welding condition, and, as a result, the welding time can be reduced. In addition, when creating the conventional wedge-shaped heat exchanger 50 itself, multi-layer welding was similarly performed in order to weld the part where the plate materials are abutted on each other. However, when creating the heat exchanger 30 of the present invention, single-layer welding can be accomplished by conducting automatic welding, and, as a result, the welding time can be reduced in the same manner. Also, in the present invention the projections 32 of the heat exchanger 30 function as the plate material 61 (lining) that are required in attaching the conventional wedge-shaped heat exchanger 50 to the shaft 60. Therefore, the amount and number of materials can be cut and the processing man-hour can be reduced.

Next is described how the powder is dried using the heat exchanging device of the present invention.

First, the powder, which is the object to be processed (powder or particle), is continuously supplied into the casing 1 in a constant amount through the feed port 9 of the heat exchanging device according to the present invention.

At this moment, a heating medium of a predetermined temperature, such as steam or hot water, is circulated through the jacket 4 to heat the casing 1 to a constant temperature. The two shafts 13, 13 are rotated by the motor via the sprocket 17 and gears 16, 16. The heating medium, such as steam or hot water, is fed to the shafts 13, 13 by the rotary joints 18, 18. The heating medium fed to each shaft 13 flows from the primary chamber 23 of the shaft 13 into the internal space 36 of the heat exchanger 30 and heats the heat exchanger 30. The heating medium is then discharged from the discharge pipes 21 of the heat exchanging medium through the secondary chamber 24 of the shaft 13 and the rotary joint 20 of the rear part of the shaft.

The powder supplied into the casing 1 is heated by the casing 1 and heat exchanger 30, and volatile matters evaporated from the powder are discharged along with carrier gas. Air, inert gas or the like, for example, is used as the carrier gas. The carrier gas supplied from the inlet ports 10, 11 passes through an upper layer part within the casing 1, is then discharged from the discharge port 12 along with the volatile parts evaporated from the powder (moisture, organic solvent, and the like) and appropriately processed outside the system. When the volatile matters are organic solvent, inert gas such as nitrogen gas is used as the carrier gas, and the discharge port 12 is coupled to a solvent condenser where the organic solvent is recovered. The carrier gas that passes through the condenser enters the casing 1 again through the inlet ports 10, 11, and the carrier gas is circulatorily used.

Flowability is generated in the powder by performing a mechanical agitating operation when the powder enters the casing 1 through the feed port 9. The fed powder then gradually flows down the casing 1 due to the pressure generated as the powder fills the feed port 9 and the inclination of the casing 1 that is provided according to need. The powder then passes through the notched recesses 31 of the heat exchanger 30 and moves to the discharge port 7.

The powder is dispersed by the rotation of the substantially hollow disk-shaped heat exchanger 30 perpendicular to a direction of travel, and at the same time the heat is exchanged so that the powder is dried efficiently. Also, because the heat exchanger 30 is formed into a substantially hollow disk to have little resistance, the compression force applied to the powder serving as the object to be processed at the time of dispersing can be suppressed as much as possible. Therefore, even when the powder is brittle and fragile, pulverization thereof can be prevented. Moreover, because the heat exchanger 30 has the notched recesses 31 directed to the center from respective circumferential edges, the powder can pass through the notched recesses 31, and the piston flowability can be secured. Therefore, the powder that is dried after an even residence time is smoothly fed toward the discharge port 7 and discharged from the discharge port 7.

The above has described the embodiments of the heat exchanging device for powder according to the present invention and of the method for manufacturing the heat exchanging device according to the present invention, but the present invention is not limited to these embodiments, and, of course, various modifications and changes thereof can be made within the scope of the technical concept of the present invention that is described in the patent claims.

A plurality of the heat exchanging devices can be coupled together in series, when the degree of dryness of the object to be processed needs to be enhanced. In addition, the shaft disposed with the heat exchangers may be added more and provided in parallel, when the amount of throughput needs to be increased.

The device of the present invention can be suitably used for drying a substance serving as the object to be processed and having a relatively small amount of evaporation, finish-drying the powder that is, for example, previously dried (powders of polypropylene, PVC, acrylic resin and the like), drying a synthetic resin chip (polyester, nylon and the like) having a little initial moisture, and drying a brittle and fragile powder an SAP (high water-absorption resin) surface reformed item, graphite granulated product, health food granules, and the like. The device of the present invention can also be used for cooling a heated and reacted substance (various inorganic substances and organic substances), reacting and the like.

INDUSTRIAL APPLICABILITY

The heat exchanging device for powder according to the present invention is used for drying, heating, cooling, or reacting powder material in a wide range of fields including synthetic resins, food products and chemical products.

The invention claimed is:

1. A heat exchanging device for powder, which comprises:

a casing having a front end and a rear end and extending lengthwise in a substantially horizontal direction, the casing configured to flow the powder in the horizontal direction from the front end to the rear end of the casing;

a shaft configured to supply a heat-exchange medium to a plurality of heat exchangers arranged along a length of the casing, the shaft being rotatably supported within the casing; and the plurality of heat exchangers each having an outer circumferential edge, are configured to generate piston flowability of the powder along an axis of the rotating shaft and in the lengthwise direction of the casing from the front end to the rear end of the casing, the plurality of heat exchangers extending radially from the axis of the shaft and respectively having a center arranged at predetermined intervals on the shaft; wherein:

at least two of the plurality of heat exchangers are hollow disk-shaped heat exchangers having a notched recess and are configured to receive the heat-exchange medium from the shaft, to exchange heat with the powder passing lengthwise through the casing, to suppress a compression force applied to the powder relative to a wedge-shaped heat exchanger, and to ensure piston flowability corresponding to the wedge-shaped heat exchanger; the notched recess facilitating piston flowability, extending perpendicularly to the powder passing lengthwise through the casing and having a radius extending from the center to the circumferential edge of the hollow disk-shaped heat exchanger at the notched recess that is less than a radius from the center to the circumferential edge of the hollow disk-shaped heat exchanger at locations other than the notched recess, and each hollow disk-shaped heat exchanger includes two disc-shaped plates having a bent rim that extends circumferentially, the bent rims of the two disc-shaped plates are curved inwardly toward each other and are joined together forming a circumferential edge around a periphery of each hollow disk-shaped heat exchanger that encloses a hollow area between the two disc-shaped plates, the hollow area extending from the bent rims to the shaft.

2. The heat exchanging device for powder according to claim 1, wherein the circumferential edge of each hollow disk-shaped heat exchanger is a continuous and smooth curve relative to the center of the disc-shaped heat exchanger that includes a convex curved portion and a concave curved portion, and the concave curved portion includes the notched recess.

3. The heat exchanging device for powder according to claim 1, wherein the bent rims are bent inwardly at approximately 30° and each hollow disk-shaped heat exchanger includes more than one notched recess arranged at regular intervals.

4. The heat exchanging device for powder according to claim 1, wherein the hollow disk-shaped heat exchangers are disposed along an axial direction of the shaft with the notched recesses of the hollow disk -shaped heat exchangers are identically aligned relative to the direction perpendicular to the axial direction of the shaft.

5. The heat exchanging device for powder according to claim 1, wherein a central part of each hollow disk-shaped heat exchanger has a projection bulging in an axial direction of the shaft, a leading end of the projection having an opening part that receives the shaft, the projection connecting each hollow disk-shaped heat exchanger to the shaft, and the hollow area of the disk-shaped heat exchanger including an area enclosed by the projection.

6. The heat exchanging device for powder according to claim 1, wherein each hollow disk-shaped heat exchanger further comprises a partition plate arranged in the hollow area and configured to adjust flow of the heat-exchange medium therein.

7. The heat exchanging device for powder according to claim 2, wherein each hollow-shaped heat exchanger includes more than one notched recess arranged at regular intervals.

8. The heat exchanging device for powder according to claim 2, wherein the hollow disk-shaped heat exchangers are disposed along an axial direction of the shaft with the notched recesses of the hollow disk-shaped heat exchangers identically aligned relative to a direction perpendicular to the axial direction of the shaft.

9. The heat exchanging device for powder according to claim 3, wherein the hollow-disk heat exchangers are disposed along an axial direction of the shaft wit h the notched recesses of the hollow disk-shaped heat exchangers identically aligned relative to a direction perpendicular to the axial direction of the shaft.

10. The heat exchanging device for powder according to claim 2, wherein a central part of each hollow disk-shaped heat exchanger has a projection bulging in an axial direction of the shaft, a leading end of the projection having an opening part that receives the shaft, the projection connecting each hollow disk-shaped heat exchanger to the shaft, and the hollow area of the disk-shaped heat exchanger including an area enclosed by the projection.

11. The heat exchanging device for powder according to claim 3, wherein a central part of each hollow disk -shaped heat exchanger has a projection bulging in an axial direction of the shaft, a leading end of the projection having an opening part that receives the shaft, the projection connecting each hollow disk-shaped heat exchanger to the shaft, and the hollow area of the disk-shaped heat exchanger including an area enclosed by the projection.

12. The heat exchanging device for powder according to claim 4, wherein a central part of each hollow disk-shaped heat exchanger has a projection bulging in the axial direction of the shaft, a leading end of the projection having an opening part that receives the shaft, the projection connecting each hollow disk-shaped heat exchanger to the shaft, and the hollow area of the disk-shaped heat exchanger including an area enclosed by the projection.

13. A heat exchanging device for powder, which comprises:

a casing having a front end and a rear end and extending lengthwise in a substantially horizontal direction, the casing configured to flow the powder in the lengthwise direction from the front end to the rear end of the casing;

a shaft configured to supply a heat-exchange medium to a plurality of heat exchanges arranged along a length of the casing, the shaft being rotatably supported within the casing; and the plurality of heat exchangers arranged at predetermined intervals on the shaft configured to generate piston flowability of the powder along an axis of the horizontally rotating shaft and in the lengthwise direction of the easing from the front end to the rear end of the casing, wherein at least two of the plurality of heat exchangers are hollow disk-shaped heat exchangers with a center attached to the shaft and with an outer circumferential edge, each of the hollow disk-shaped heat exchangers having a notched recess and is configured to receive the heat-exchange medium from the shaft, to exchange heat with the powder passing lengthwise through the casing, to suppress a compression force applied to the powder relative to a wedge-shaped heat exchanger and to ensure piston flowability of powder through the heat exchanger device corresponding to the wedge-shaped heat exchanger, the notched recess facilitating piston flowability, each hollow disk-shaped heat exchanger includes two disc-shaped plates having a bent rim that extends circumferentially, the bent rims of the two disc-shaped plates are curved inwardly toward each other and are joined together forming a circumferential edge around a periphery of each hollow disk-shaped heat exchanger that encloses a hollow area between the two disc-shaped plates, the hollow area extending from the bent rims to the shaft, and the notched recess encompassing part of the circumferential edge of each hollow-shaped heat exchanger that has a continuous and smooth curve relative to the center of each disk-shaped heat exchanger, the continuous and a smooth curve including a continuously convex curved portion and a concave curved portion, and the notched recess is located at the one concave curved portion, and a radius from the center to the circumferential edge of each hollow disk-shaped heat exchanger at the notched recess is less than a radius from the center to the circumferential edge of each hollow disk-shaped heat exchanger at locations other than the notched recess.

* * * * *